US005559760A

United States Patent [19]

Schneider

[11] Patent Number: 5,559,760

[45] Date of Patent: Sep. 24, 1996

[54] WRISTWATCH WITH HIGH-FREQUENCY TRANSMITTER

[75] Inventor: Ernest Schneider, Evilard, Switzerland

[73] Assignee: Breitling S. A., Grenchen, Switzerland

[21] Appl. No.: 557,313

[22] Filed: Nov. 14, 1995

[30] Foreign Application Priority Data

Dec. 20, 1994 [CH] Switzerland ..... 3842/94

[51] Int. Cl.[6] ..... G04B 47/00

[52] U.S. Cl. ..... 368/10; 368/278

[58] Field of Search ..... 368/10, 47–61, 368/327, 278, 281–282

[56] References Cited

U.S. PATENT DOCUMENTS 5,235,563 8/1993 Ganter et al. ..... 368/47
5,253,226 10/1993 Ganter ..... 368/47

FOREIGN PATENT DOCUMENTS 2539233 7/1984 France .
673748 4/1990 Switzerland .

OTHER PUBLICATIONS

Japanese Patent Abstract (No. 52—152759, dated Dec. 19, 1977).

*Primary Examiner*—Bernard Roskoski
*Attorney, Agent, or Firm*—Kane, Dalsimer, Sullivan, Kurucz, Levy, Eisele and Richard, LLP

[57] ABSTRACT

Wristwatch equipped with a high-frequency transmitter comprising an extensible antenna in the form of a wire wound up in a first housing and a second antenna forming a counterpoise and wound up, before use, in a second housing. These two antennae are each fastened to a plug by means of which the antennae can be unfurled by pulling, the plugs becoming detached when the antennae are completely unfurled.

The transmitter essentially constitutes a distress beacon and the presence of a counterpoise antenna has the effect of significantly amplifying the radiating power of the transmitter without consuming additional energy.

8 Claims, 2 Drawing Sheets

WRISTWATCH WITH HIGH-FREQUENCY TRANSMITTER

FIELD OF THE INVENTION

The subject of the present invention is a wristwatch comprising, in addition to a device for measuring and displaying the time, a high-frequency transmitter, a current source for the supply to this transmitter, a switch for turning on the transmitter and an extensible antenna in the form of a wire wound up in a housing of the watch before use, one of whose ends is fastened to the watch, the other end being secured to a plug removably fastened to the watch before use of the transmitter, the antenna being unfurled by pulling on the plug, this unfurling moreover having the effect of closing the switch and turning on the transmitter.

PRIOR ART

Such a watch has already been produced by the Applicant. It is described in Swiss Patent No. 673 748. This prior watch comprises two superimposed casings, the upper casing containing a clockwork movement and the lower casing a capsule used simultaneously as container for the transmitter and as rotary drum for winding up the antenna wire. Pulling on the plug connected to the antenna has the effect of rotating the capsule and of establishing contact between a supply battery and the transmitter. Such a watch is intended to be used as a distress beacon and it is essential for the range of the transmitter to be sufficient for the distress signal to be received.

SUMMARY OF THE INVENTION

The principal object of the present invention is to increase the radiating power of the transmitter, and to do so without increasing the consumption of electrical energy, such as not to reduce the duration of transmission of the distress signal transmitted for as long as the battery delivers sufficient current.

The wristwatch according to the invention is characterized in that it is equipped with a counterpoise antenna of the same type as the main antenna and also wound up, before use, in a housing of the watch and one end of which is also secured to a plug removably fastened to the watch before use, this counterpoise antenna being arranged in such a way as to be able to be unfurled in a direction opposite to that of the main antenna.

The appending of a counterpoise antenna has the effect of significantly amplifying the radiating power of the transmitter without consuming additional energy.

A particular embodiment of the invention is defined in the dependent claims. This embodiment has several advantages by comparison with the prior art. In particular, the transmitter, the switch and the antennae are arranged in the same casing as the clockwork movement, this making it possible to reduce the thickness of the watch. The antennae are made from a ductile material, for example nickel, and the plugs are fastened to the antennae in such a way that they become detached when the pulling force on the plug has exceeded the force required for the complete unfurling of the antennae. Thus, the antennae freed of the weight of the plug do not flex but remain straight. The antennae are wound up helically, this making it possible to house them in cylindrical housings made in the band of the watch.

The appended drawings represent, by way of example, an embodiment of a watch according to the invention.

DESCRIPTION OF THE PREFERRED EMBODIMENT

Figure 1:
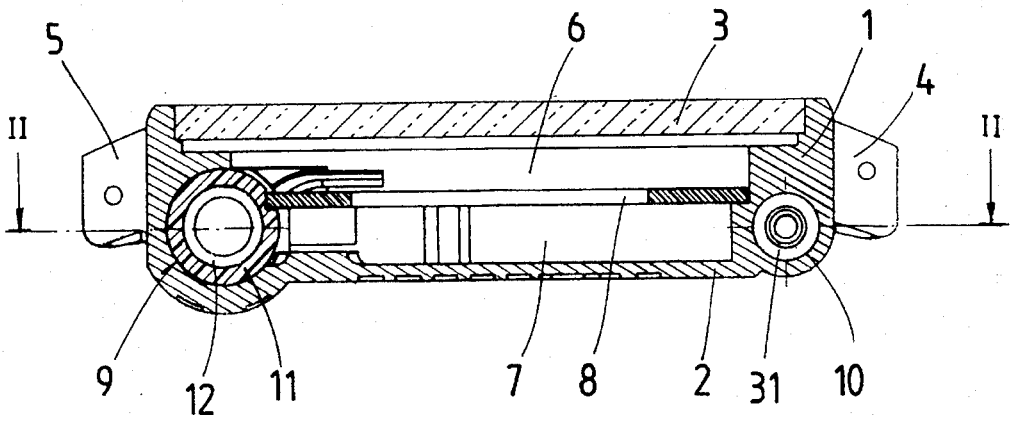
FIG. 1 represents a sectional view thereof along 6h 00–12h 00 or I—I of FIG. 2.
Figure 2:
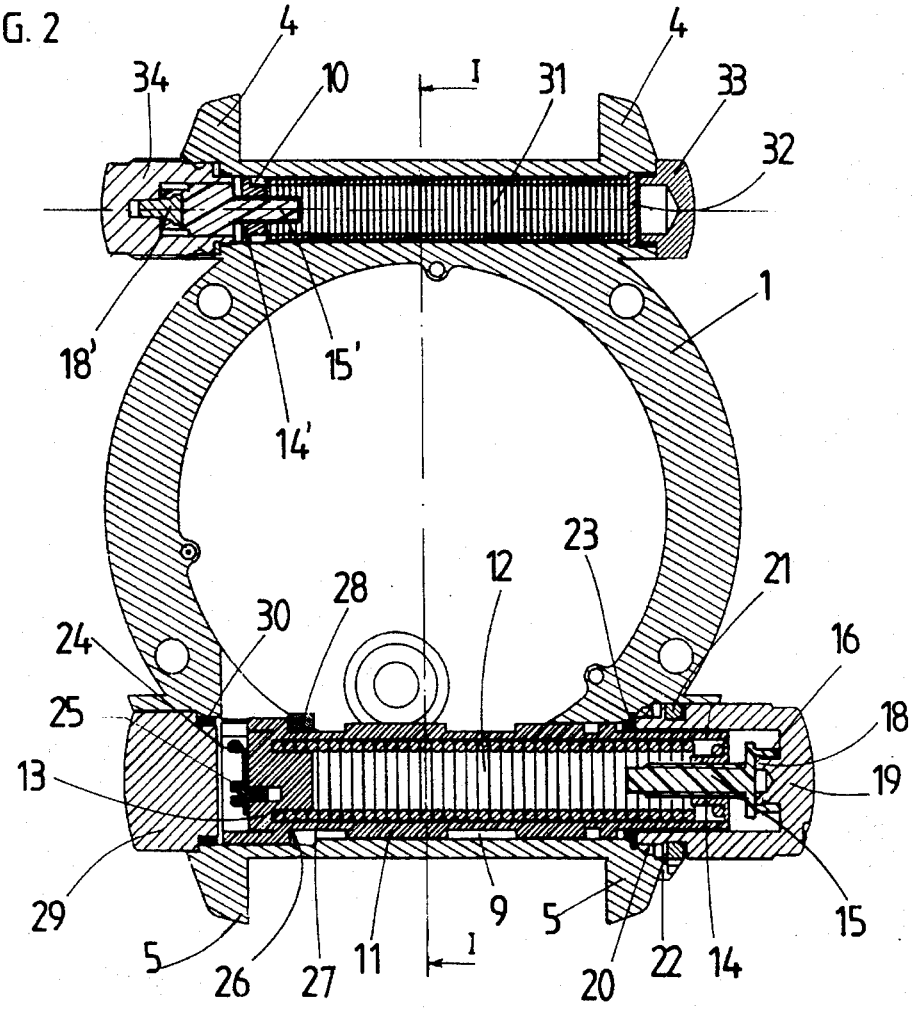
FIG. 2 is a sectional view along II—II of FIG. 1 showing the antennae wound up in the casing.

Depicted in FIG. 1 is a watch case consisting of a bezel-band 1 made in one piece with a back 2 and of a crystal 3. The bezel-band 1 is furnished with two pairs of horns 4 and 5 for fastening a strap. The upper part 6 of the watch case is intended to receive a clockwork movement surmounted by a dial. The lower part 7 of the case accommodates a high-frequency transmitter mounted on a printed circuit 8. Two parallel cylindrical housings 9 and 10 are made within the mass of the band, near the horns. The housing 9 encroaches slightly into the interior of the case, whereas the housing 10, of smaller diameter, is entirely surrounded by the material of the band.

Figure 3:
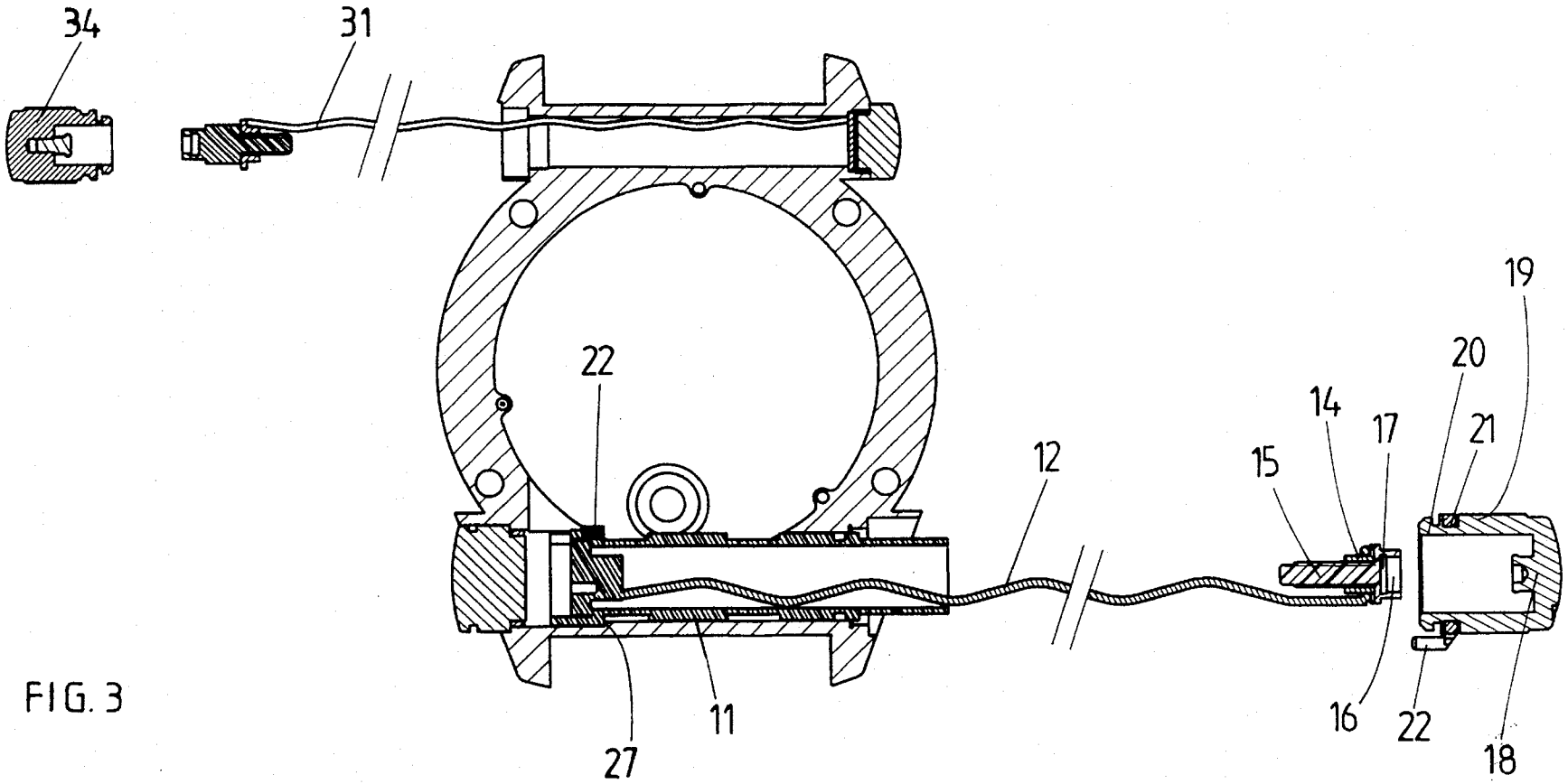
FIG. 3 is a view similar to the view represented in FIG. 2, but after complete unfurling of the main antenna and of the counterpoise.

In the cylindrical housing 9 is mounted slidably a tube 11 made of synthetic material within which is wound up helically in tight turns a nickel wire 12, one end of which is fastened to the back 13 of the tube 11, the other end being fastened to a collar 14 itself fastened to a spigot 15 made of plastic. In this instance, the spigot 15 is screwed into the collar 14 with left-handed threading. The spigot 15 is lengthened via a cylindrical hollow part 16 in the bottom of which is made an annular groove 17 (FIG. 3). This hollow part 16 is forcibly fastened to a dome 18 formed at the back of a hollow cylindrical plug 19 having a threaded part 20 via which it is screwed, right-handed, into one end of the housing 9. The plug 19 is moreover furnished with a safety ring 21, made of plastic, mounted in a groove in the plug and furnished with a lug 22 fastened to the bezel-band and guarding against any unintentional unscrewing of the plug 19. Sealing is provided for by a gasket 23 mounted between the end of the plug and a land formed in the housing 9. The other end of the wire 12 is connected to a tag 24 fastened to the back 13 of the tube 11 by a screw 25. The tag 24 is itself connected electrically to the circuit 8 of the transmitter.

The tube 11 has a peripheral shoulder 26 cooperating on the one hand with a stop 27 in order to limit the travel of the tube 11 and on the other hand with a switch 28 whose function is to provide for the supply to the transmitter. The other end of the cylindrical housing 9 is closed by a non-removable plug 29, fastened for example by gluing, a gasket 30 providing for the sealing here.

In the other cylindrical housing 10 of the band, diametrally opposite the housing 9, is housed a nickel wire 31 of a smaller diameter than the diameter of the wire 12. The wire 31 is also wound up helically in tight turns within its housing. One of the ends of the wire 31 is fastened, for example by soldering, to a metal disc 32 driven hard into a bore formed at one of the ends of the housing 10. This bore is itself closed by a plug 33 fastened permanently, for example by gluing. The other end of the wire 31 is fastened to a plug 34 screwed to the end of the housing 10. The fastening of the wire 31 to the plug 34 is carried out in the same way as the fastening of the wire 12 to the plug 19, the collar 14' being screwed onto the spigot 15' fastened to a dome 18' of the plug 34.

The frequency of the transmitter is for example 121.5 MHz.

When the user wishes to operate the transmitter, he firstly unscrews the plug 19, this having the effect of breaking the lug 22 of the safety ring 21 and of screwing the spigot 15 into the collar 14. The antenna 12 is next unfurled by pulling brusquely on the plug 19. In the example considered, the antenna is completely unfurled, as represented, above a certain pull. The connection of the spigot 15 to the dome 18 of the plug is such that the plug 19 becomes detached from the spigot 15 for a pull lying within a previously defined range. There is thus no risk of the wire 12 being torn from the tube 11 and no risk of the switch 22 being damaged. Furthermore, the wire 12 is freed of the weight of the plug 19 tending to make the antenna sag. The pull on the wire 12 has the effect of entraining the tube 11 and of actuating the switch 28. The transmitter is then powered.

The user next unscrews the plug 34 and unfurls the wire 31, pulling it via the plug as for the wire 12. The unfurled wire 31 constitutes the counterpoise of the main antenna 12. Electrical connection between the counterpoise 31 and the transmitter is provided for by the bezel-band 1.

The lengths of the antennae have been established experimentally.

Removal of the plugs 29 and 33 allows the watch to be re-equipped after use.

The size of the antennae 12 and 31 is adapted to the value of the frequency.

The invention is of course not limited to all the enhancements appearing in the example embodiment described above, but it extends also, for example, to a wristwatch such as described in Swiss Patent No. 673 748 supplemented with a counterpoise antenna wound up as a coil spring or on a drum.

I claim:

1. Wristwatch comprising, in addition to a device for measuring and displaying the time, a high-frequency transmitter, a current source for the supply to this transmitter, a switch for turning on the transmitter, an extensible antenna in the form of a wire wound up in a housing of the watch before use, one of whose ends is fastened to the watch, the other end being secured to a plug removably fastened to the watch before use of the transmitter, the antenna being unfurled by pulling on the plug, this unfurling moreover having the effect of closing the switch and turning on the transmitter and a counterpoise antenna of the same type as the main antenna and also wound up, before use, in a housing of the watch and one end of which being also secured to a plug removably fastened to the watch before use, said counterpoise antenna being arranged in such a way as to be able to be unfurled in a direction opposite to that of the main antenna.

2. Wristwatch according to claim 1, wherein the transmitter, the switch and the antennae are arranged in the same casing as the device for measuring and displaying the time.

3. Wristwatch according to claim 2, wherein the antennae are made from a ductile material, for example nickel.

4. Wristwatch according to claim 3, the casing of which comprises a band, wherein the antennae are wound up helically in cylindrical housings made within the band and closed by the said plugs.

5. Wristwatch according to claim 4, wherein the plugs are fastened to the antennae in such a way that they become detached from the antenna when the pulling force on the plug has exceeded the force required for the complete unfurling of the antenna.

6. Wristwatch according to claim 5, wherein the plugs have a dome to which is forcibly fastened a spigot of synthetic material, itself fastened to the end of the antenna in such a way that the said dome becomes detached from the spigot when the pulling force on the plug has exceeded the force required for the complete unfurling of the antenna.

7. Wristwatch according to claim 5, wherein the main antenna is, before unfurling, wound up helically in a tube mounted slidably in the casing and furnished with a shoulder cooperating with the switch for the actuation of the latter.

8. Wristwatch according to claim 6, wherein the said shoulder also cooperates with a stop, limiting the travel of the tube.

* * * * *